US011721912B2

(12) United States Patent
Futagami et al.

(10) Patent No.: US 11,721,912 B2
(45) Date of Patent: Aug. 8, 2023

(54) ANTENNA DEVICE

(71) Applicant: Murata Manufacturing Co., Ltd., Nagaokakyo (JP)

(72) Inventors: Dai Futagami, Nagaokakyo (JP); Takaya Nemoto, Nagaokakyo (JP)

(73) Assignee: MURATA MANUFACTURING CO., LTD., Nagaokakyo (JP)

( * ) Notice: Subject to any disclaimer, the term of this patent is extended or adjusted under 35 U.S.C. 154(b) by 305 days.

(21) Appl. No.: 17/213,245

(22) Filed: Mar. 26, 2021

(65) Prior Publication Data

US 2021/0226345 A1 Jul. 22, 2021

Related U.S. Application Data

(63) Continuation of application No. PCT/JP2019/033975, filed on Aug. 29, 2019.

(30) Foreign Application Priority Data

Sep. 27, 2018 (JP) ..... 2018-181165

(51) Int. Cl.
*H01Q 19/06* (2006.01)
*H01Q 21/06* (2006.01)
(Continued)

(52) U.S. Cl.
CPC ..... *H01Q 21/065* (2013.01); *H01Q 9/0407* (2013.01); *H01Q 19/06* (2013.01); *H01Q 21/0075* (2013.01)

(58) Field of Classification Search
CPC ..... H01Q 19/06; H01Q 1/38; H01Q 9/0407; H01Q 13/08; H01Q 21/065; H01Q 21/0075
See application file for complete search history.

(56) References Cited

U.S. PATENT DOCUMENTS 7,088,290 B2 * 8/2006 Ohno ..... H01Q 21/064 343/700 MS
7,161,555 B2 * 1/2007 Ohno ..... H01Q 21/061 343/785

(Continued)

FOREIGN PATENT DOCUMENTS

EP 0280379 A2 8/1988
JP 63-224507 A 9/1988

(Continued)

OTHER PUBLICATIONS

Written Opinion of the International Searching Authority dated Oct. 21, 2019, received for PCT Application PCT/JP2019/033975, Filed on Aug. 29, 2019, 5 pages. (Previously filed; submitting English translation only.).

(Continued)

*Primary Examiner* — Hasan Islam
(74) *Attorney, Agent, or Firm* — Xsensus LLP

(57) ABSTRACT

A patch antenna is constituted by a radiation element disposed on a substrate and a ground conductor disposed in the substrate. A dielectric member is disposed to at least partially cover the radiation element as viewed from above. The dielectric member is disposed on a side opposite a side on which the ground conductor is disposed as viewed from the radiation element. When a direction of a normal line to the radiation element is assumed as a height direction and when an imaginary plane perpendicular to the height direction is assumed as a reference plane, the dielectric member has a side surface which tilts with respect to the reference plane. The dielectric member has no focal point for a radio wave entering the dielectric member in parallel with the height direction.

20 Claims, 8 Drawing Sheets

(51) Int. Cl.
*H01Q 9/04* (2006.01)
*H01Q 21/00* (2006.01)

(56) References Cited

U.S. PATENT DOCUMENTS

| | | | | |
|---|---|---|---|---|
| 2010/0156754 | A1* | 6/2010 | Kondou ..... | H01Q 9/0485 343/911 R |
| 2015/0346334 | A1 | 12/2015 | Nagaishi et al. | |

FOREIGN PATENT DOCUMENTS

| | | | |
|---|---|---|---|
| JP | 1-243605 | A | 9/1989 |
| JP | 3-139903 | A | 6/1991 |
| JP | 2005-130464 | A | 5/2005 |
| WO | 2014/125716 | A1 | 8/2014 |
| WO | 2017/003374 | A1 | 1/2017 |
| WO | 2018/115372 | A1 | 6/2018 |

OTHER PUBLICATIONS

Chinese Office Action dated Dec. 23, 2022, in corresponding Chinese Patent Application 201980063633.8, 7pp.
International Search Report and Written Opinion dated Oct. 21, 2019, received for PCT Application PCT/JP2019/033975, Filed on Aug. 29, 2019, 9 pages including English Translation.

* cited by examiner

ANTENNA DEVICE

CROSS-REFERENCE TO RELATED APPLICATIONS

This application is a continuation of International Patent Application No. PCT/JP2019/033975, filed on Aug. 29, 2019, which claims priority to JP 2018-181165, filed Sep. 27, 2018, the entire contents of each are incorporated herein by reference.

TECHNICAL FIELD

The present disclosure relates to an antenna device.

BACKGROUND ART

A dielectric-loaded array antenna including plural unit antennas is known in which a dielectric equivalent is disposed on each of the unit antennas (see Patent Document 1). Patch antennas are used as the unit antennas, and a dielectric having the shape of a rectangular parallelepiped is disposed on each of the patch antennas. The length, the width, and the height of the dielectric are respectively 1.25 times, 1.25 times, and 1.42 times as large as the wavelength. By disposing the dielectric in this manner, the aperture efficiency of each unit antenna is enhanced.

CITATION LIST

Patent Document

Patent Document 1: Japanese Unexamined Patent Application Publication No. H01-243605

SUMMARY

Technical Problems

As recognized by the present inventor, it is desirable to achieve a wider band of a dielectric-loaded antenna device. It is an object of the present disclosure to provide an antenna device that is able to achieve a wider band.

Solution to Problem

According to an aspect of the present disclosure, there is provided an antenna device including a patch antenna and a dielectric member. The patch antenna includes a radiation element disposed in or on a substrate and a ground conductor disposed in or on the substrate. The dielectric member is homogeneous and is disposed to at least partially cover, in a plan view, the radiation element and is disposed on a side opposite a side on which the ground conductor is disposed as viewed from the radiation element. Under a condition a direction of a normal line to the radiation element is assumed as a height direction and under a condition an imaginary plane perpendicular to the height direction is assumed as a reference plane, the dielectric member has a side surface which tilts with respect to the reference plane. Under another condition in which a value that is obtained by dividing a dimension of the radiation element in an excitation direction by a square root of a relative permittivity of the dielectric member is set to be a reference value, a diameter that defines a circular shaped area of a top surface of the dielectric member is in an inclusive range of 1.8 through 3.8 times as large as the reference value According to another aspect of the present disclosure, there is provided an antenna device including a patch antenna and a dielectric member. The patch antenna includes a radiation element disposed in or on a substrate and a ground conductor disposed in the substrate. The dielectric member is disposed to at least partially cover, in a plan view, the radiation and is disposed on a side opposite a side on which the ground conductor is disposed as viewed from the radiation element. Under a condition a direction of a normal line to the radiation element is assumed as a height direction and under a condition an imaginary plane perpendicular to the height direction is assumed as a reference plane, the dielectric member has a side surface which tilts with respect to the reference plane. The dielectric member has no focal point for a radio wave entering the dielectric member in parallel with the height direction. Also, under another condition in which a value that is obtained by dividing a dimension of the radiation element in an excitation direction by a square root of a relative permittivity of the dielectric member is set to be a reference value, a diameter that defines a circular shaped area of a top surface of the dielectric member is in an inclusive range of 1.8 through 3.8 times as large as the reference value.

Advantageous Effects of Disclosure

By loading the above-described dielectric member into a patch antenna, it is possible to achieve a wider band.

DESCRIPTION OF EMBODIMENTS

First Embodiment

An antenna device according to a first embodiment will be described below with reference to FIGS. 1 through 4.

Figure 1:
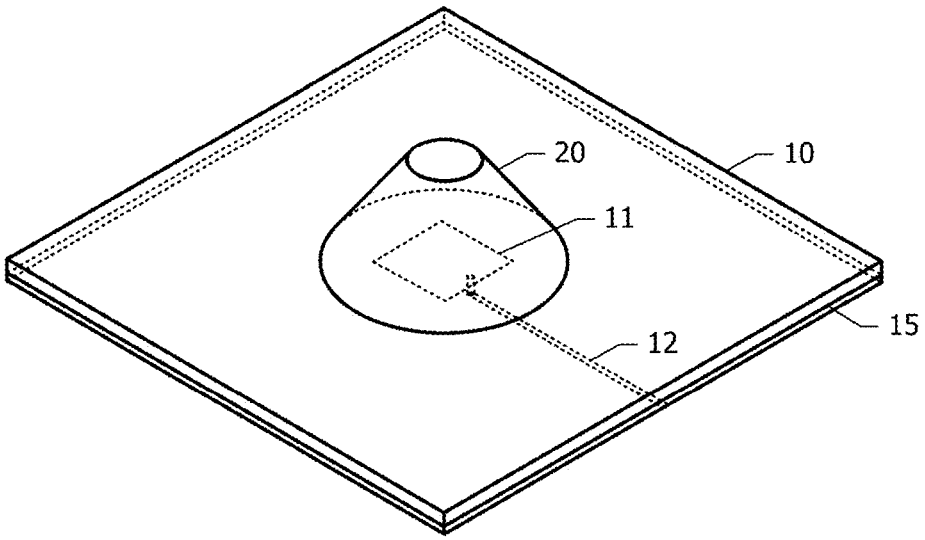
FIG. 1 is a perspective view of an antenna device according to a first embodiment.

FIG. 1 is a perspective view of the antenna device according to the first embodiment. A radiation element 11 is disposed in or on the top surface, which is one of the surfaces of a substrate 10 made of a dielectric material, while a ground conductor 15 is disposed in or on an inner layer of the substrate 10. The radiation element 11 and the ground conductor 15 form a patch antenna. The radiation element 11 is formed in a square planar shape. The radiation element 11 may be formed in another planar shape, such as a rectangle or a circle.

A dielectric member 20 is disposed on the substrate 10 (on the side of the substrate 10 opposite the side on which the ground conductor 15 is disposed as viewed from the radiation element 11) so that it at least partially covers the radiation element 11 as viewed from above. While the term "dielectric member" is used as a term of convenience, the dielectric member 20 is a body of material have a dielectric property. The dielectric member 20 is an integrally molded member using a homogeneous dielectric material and is bonded to the radiation element 11 and the substrate 10 with an adhesive, for example. The permittivity of the inside of the dielectric member 20 is uniform. A feed line 12 is provided on the bottom surface of the substrate 10. The feed line 12 is coupled with the radiation element 11 by means of a via-hole within a clearance hole formed in the ground conductor 15.

The dielectric member 20 is formed in the shape of a truncated cone. The dielectric member 20 has a circular bottom surface facing the radiation element 11, a circular top surface opposing the bottom surface, and a side surface connecting the bottom surface and the top surface. The bottom surface and the top surface are parallel with each other, and the top surface is smaller than the bottom surface. A cross section of the dielectric member 20 in a plane passing through the center of the bottom surface and the center of the top surface is an isosceles trapezoid. In this specification, the direction of a normal line to the radiation element 11 is defined as the height direction, and an imaginary plane perpendicular to the height direction is defined as a reference plane. The side surface of the dielectric member 20 tilts with respect to the reference plane. The dielectric member 20 may be made of ceramics, such as low-temperature co-fired ceramics (LTCC), or a resin, such as polyimide. The relative permittivity εr of LTCC is about 6.4, while that of polyimide is about 3.

As viewed from above, the centers of the top and bottom surfaces of the dielectric member 20 and the center of the radiation element 11 coincide with each other. The bottom surface of the dielectric member 20 includes the radiation element 11 therein as viewed from above. Typically, the bottom surface of the dielectric member 20 is larger than the minimum bounding circle of the radiation element 11 as viewed from above. "Minimum bounding circle" refers to a minimum circle including a bounded region on a plane. If a bounded region is a square or a rectangle, the region surrounded by the circumference passing the four vertices of the bounded region is a minimum bounding circle.

Figure 2:
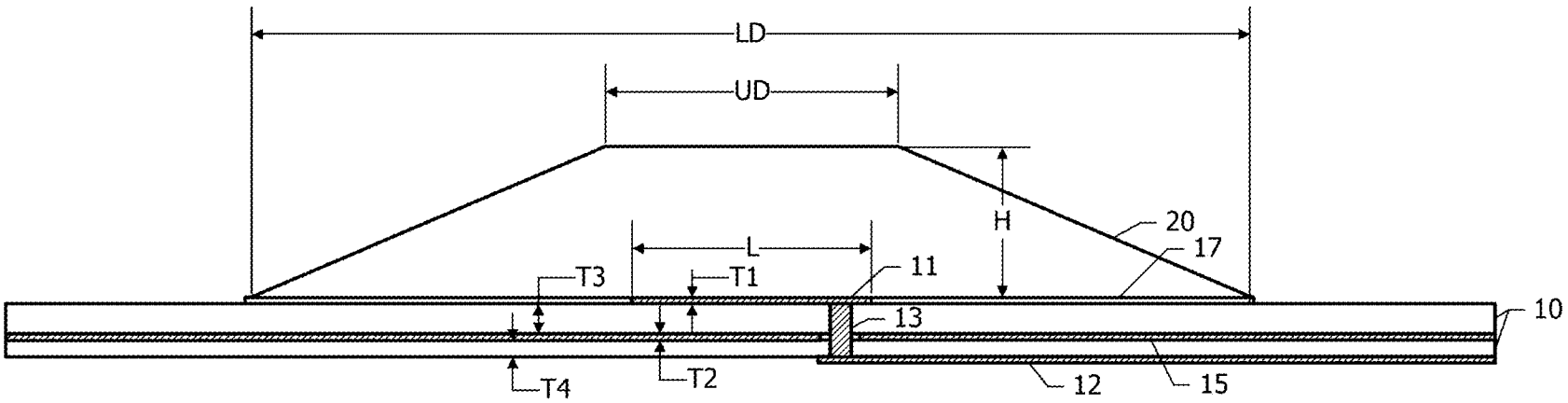
FIG. 2 is a sectional view of the antenna device according to the first embodiment.

FIG. 2 is a sectional view of the antenna device of the first embodiment. The radiation element 11 is disposed on the top surface of the substrate 10. The ground conductor 15 is disposed in or on the inner surface of the substrate 10. The feed line 12 is disposed on the bottom surface of the substrate 10. The feed line 12 is coupled with the radiation element 11 by means of a via-conductor 13 passing through the clearance hole formed in the ground conductor 15. An adhesive layer 17 is disposed between the substrate 10 and the dielectric member 20. Although the feed line 12 is disposed on the bottom surface of the substrate 10 in FIG. 2, it may be disposed in or on an inner layer of the substrate 10.

Regarding the dielectric member 20, the diameter of the bottom surface is represented by LD, the diameter of the top surface is represented by UD, and the height is designated by H. Regarding the radiation element 11, the length of each side is represented by L, while the thickness is indicated by T1. The thickness of the ground conductor 15 is designated by T2. Regarding the substrate 10, T3 designates the thickness between the radiation element 11 and the ground conductor 15, while T4 indicates the thickness of the substrate 10 under the ground conductor 15. As an example, the diameter LD is 5 mm, the diameter UD is 1 mm, and the height H is 0.5 mm.

Advantages of the first embodiment will be described below.

A simulation was conducted by the inventors of the disclosure of this application and shows that the antenna device according to the first embodiment achieves a wider band compared with a known antenna device including a dielectric member formed in a rectangular parallelepiped. A wider band achieved by the antenna device of the first embodiment may be due to multi-resonance generated as a result of radio waves radiated from the radiation element 11 (FIG. 1) being reflected in the dielectric member 20.

The simulation conducted by the inventors of the disclosure of this application will be discussed below with reference to FIGS. 3 and 4.

Return loss S11 was found in a frequency range of 50 to 70 GHz by varying the height, the bottom surface, and the top surface of the dielectric member 20. The length L of each side of the radiation element 11 was 0.8 mm. The thickness T1 of the radiation element 11 and the thickness T2 of the ground conductor 15 were both 15 μm. The thickness T3 and the thickness T4 of the substrate 10 (FIG. 2) were 100 μm and 65 μm, respectively. The relative permittivity εr of the dielectric member 20 and the substrate 10 was about 6.4.

Figure 3:
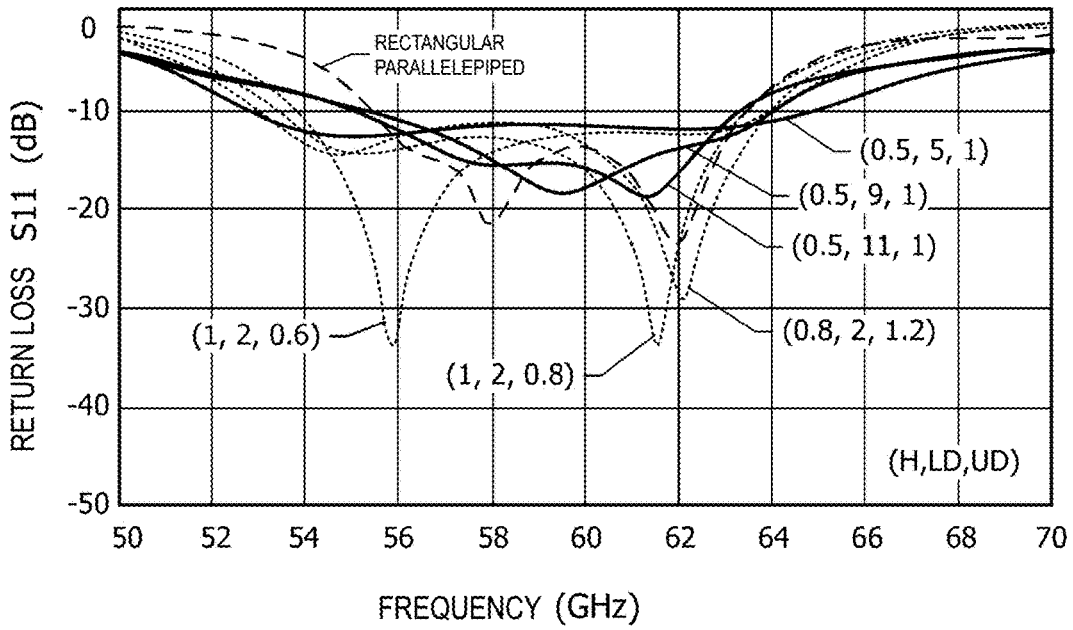
FIG. 3 is a graph illustrating the simulation results regarding the relationship between the frequency and the return loss S11 of the antenna device of the first embodiment.

FIG. 3 is a graph illustrating the simulation results regarding the relationship between the return loss S11 and the frequency. The horizontal axis indicates the frequency by the unit "GHz", while the vertical axis indicates the return loss S11 by the unit "dB". The three numeric values in parentheses appended to the solid lines and the broken lines in the graph in FIG. 3 refer to the height H, the diameter LD of the bottom surface, and the diameter UD of the top surface sequentially from the left by using the unit "mm". For the sake of reference, the return loss S11 of an antenna device including a dielectric member formed in a rectangular parallelepiped is indicated by the long dashed line.

The range in which the return loss S11 is lower than or equal to −10 dB may be considered as a frequency band in which the antenna device can transmit and receive signals with high efficiency. It can be said that "a wider band" is achieved when the frequency band in which the return loss S11 is not higher than −10 dB is increased. The dimensions of the dielectric member in a rectangular parallelepiped were optimized to maximize the frequency bandwidth. The frequency bandwidth obtained by using the dielectric member having the optimized dimensions was about 8 GHz. The graph shows that the dielectric member 20 formed in a truncated cone according to the first embodiment achieves a wider band when the height H is in a range of 0.5 to 1 mm, the diameter LD of the bottom surface is in a range of 2 to 11 mm, and the diameter UD of the top surface is in a range of 0.6 to 1.2 mm, for example, compared with the dielectric member formed in a rectangular parallelepiped. These ranges of the dimensions of the dielectric member 20 will be called first suitable ranges.

Figure 4:
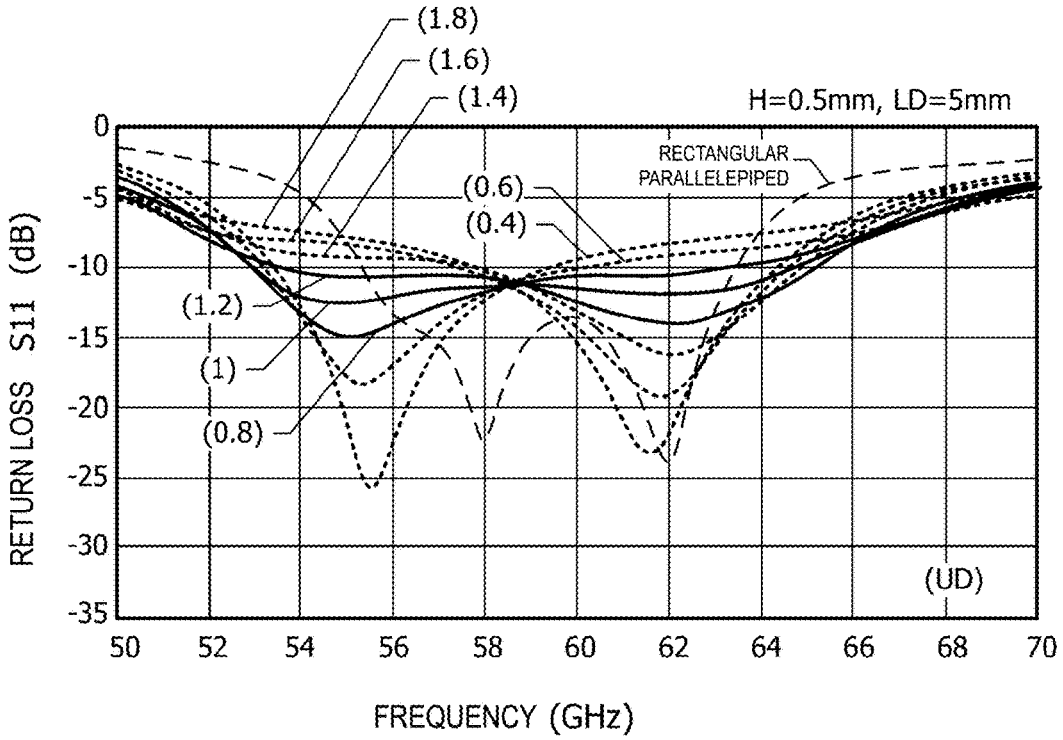
FIG. 4 is a graph illustrating the simulation results regarding the relationship between the frequency and the return loss S11 of the antenna device of the first embodiment obtained by varying the diameter UD of the top surface of a dielectric member of the antenna device while fixing the height H and the diameter LD of the bottom surface of the dielectric member to 0.5 mm and 5 mm, respectively.

FIG. 4 is a graph illustrating the simulation results regarding the relationship between the return loss S11 of the antenna device of the first embodiment and the frequency obtained by varying the diameter UD of the top surface of the dielectric member 20 while fixing the height H and the diameter LD of the bottom surface to 0.5 mm and 5 mm, respectively. As indicated by the solid lines in FIG. 4, it is seen that a wider band is achieved by the dielectric member 20 in the first embodiment when the diameter UD of the top surface is in a range of 0.8 to 1.2 mm, compared with the dielectric member formed in a rectangular parallelepiped. In this manner, even when the diameter UD of the top surface is changed from the optimal value by ±20%, a sufficiently wide band is implemented. The optimal value is a value that can maximize the frequency bandwidth when the value of a given parameter is changed while the values of the other parameters are fixed.

Likewise, it can be assumed that a sufficiently wide band is implemented when the height H or the diameter LD of the bottom surface is changed from the optimal value by ±20%.

It is seen from the simulation results in FIG. 3 that a wider band is achieved when the diameter LD of the bottom surface is in a range of 5 to 11 mm while the height H and the diameter UD of the top surface are fixed to 0.5 mm and 1 mm, respectively. A sufficiently wide band is likely to be implemented when the diameter LD of the bottom surface is in a range of 5 to 11 mm while the height H is changed by ±20% to be in a range of 0.4 to 0.6 mm and the diameter UD of the top surface is changed by ±20% to be in a range of 0.8 to 1.2 mm. These ranges of the dimensions of the dielectric member 20 will be called second suitable ranges.

It is also seen from the simulation results in FIG. 3 that a wider band is achieved when the height H is in a range of 0.8 to 1 mm and the diameter UD of the top surface is in a range of 0.6 to 1.2 mm while the diameter LD of the bottom surface is fixed to 2 mm. A sufficiently wide band is likely to be implemented when the height H is in a range of 0.8 to 1 mm and the diameter UD of the top surface is in a range of 0.6 to 1.2 mm while the diameter LD of the bottom surface is changed by ±20% to be in a range of 1.6 to 2.4 mm. These ranges of the dimensions of the dielectric member 20 will be called third suitable ranges.

The above-described preferable dimensions of the dielectric member 20 vary depending on the wavelength of radio waves inside the dielectric member 20. The wavelength of radio waves inside the dielectric member 20 varies depending on the dimension of the radiation element 11 in the excitation direction and the relative permittivity $\varepsilon r$ of the dielectric member 20. More specifically, the wavelength of radio waves inside the dielectric member 20 is determined by the value obtained by dividing the dimension of the radiation element 11 in the excitation direction by the square root of the relative permittivity $\varepsilon r$ (hereinafter such a value will be called a reference value).

In the above-described simulation of the first embodiment, since the length L of each side of the radiation element 11 is 0.8 mm, the dimension of the radiation element 11 in the excitation direction is 0.8 mm. In the above-described simulation, the relative permittivity $\varepsilon r$ of the dielectric member 20 is 6.4. Accordingly, the reference value is about 0.316 mm. The preferable ranges of the dimensions of the dielectric member 20 are determined based on this reference value.

The above-described first suitable ranges of the dimensions of the dielectric member 20 may be expressed as follows based on the reference value. The first suitable range of the height H is 1.5 to 3.2 times as large as the reference value. The first suitable range of the diameter LD of the bottom surface is 6.3 to 35 times as large as the reference value. The first suitable range of the diameter UD of the top surface is 1.8 to 3.8 times as large as the reference value.

The above-described second suitable ranges of the dimensions of the dielectric member 20 may be expressed as follows based on the reference value. The second suitable range of the height H is 1.2 to 1.9 times as large as the reference value. The second suitable range of the diameter LD of the bottom surface is 15 to 35 times as large as the reference value. The second suitable range of the diameter UD of the top surface is 2.5 to 3.8 times as large as the reference value.

The above-described third suitable ranges of the dimensions of the dielectric member 20 may be expressed as follows based on the reference value. The third suitable range of the height H is 2.5 to 3.2 times as large as the reference value. The third suitable range of the diameter LD of the bottom surface is 5 to 7.6 times as large as the reference value. The third suitable range of the diameter UD of the top surface is 1.8 to 3.8 times as large as the reference value.

The dielectric member 20 is made of a homogeneous dielectric material and is an integrally molded member without any portion subjected to secondary adhesion or mechanical bonding. It is thus easy to form the oblique side surface to be smooth, which can suppress the scattering of radio waves. The dielectric member 20 does not have any boundary face inside, which can also suppress the scattering of radio waves. As a result, loss caused by the scattering of radio waves can be reduced. Moreover, the dielectric member 20 is not subjected to secondary adhesion or mechanical bonding and is thus easy to manufacture, thereby making it less likely to vary the quality among individual dielectric members 20.

The dielectric member 20 in the first embodiment is formed in a truncated cone and has no focal point for radio waves entering the dielectric member 20 in parallel with the height direction of the dielectric member 20. If a dielectric member has a focal point and a radiation element is placed at the focal point, the radiation element and the dielectric member function as a dielectric lens antenna. In this case, if the relative position between the dielectric member and the radiation element is misaligned, the antenna characteristics are significantly changed. In the first embodiment, the dielectric member 20 has no focal point, which makes it less likely to change the characteristics of the antenna device due to the relative misalignment between the dielectric member 20 and the radiation element 11 (FIG. 1). When assembling the antenna device, extremely high positional accuracy, such as adjusting the radiation element to the position of the focal point, is not required.

In the first embodiment, as the dielectric member 20 loaded into the antenna device, a dielectric member which is homogeneous and has no focal point is used. Alternatively, a dielectric member 20 that satisfies at least one of the conditions "being homogeneous" and "having no focal point" may be used.

Second Embodiment

An antenna device according to a second embodiment will be described below with reference to FIGS. 5 and 6. An explanation of the elements configured in the same manner as the antenna device of the first embodiment (FIGS. 1 and 2) will be omitted.

Figure 5:
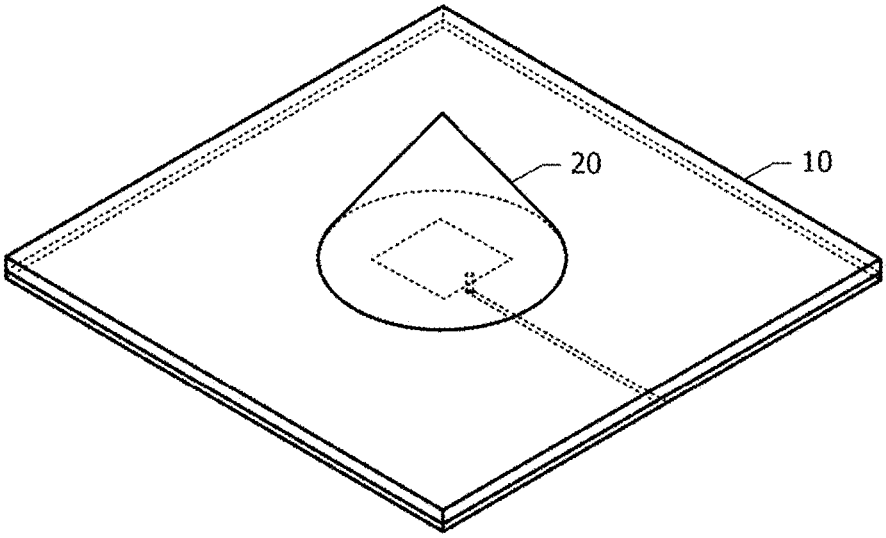
FIG. 5 is a perspective view of an antenna device according to a second embodiment.

FIG. 5 is a perspective view of the antenna device according to the second embodiment. In the first embodiment, the dielectric member 20 (FIG. 1) is formed in a truncated cone. In the second embodiment, the dielectric member 20 is formed in a conical shape. This corresponds to the configuration in which the diameter UD (FIG. 2) of the top surface of the dielectric member 20 of the first embodiment is 0.

Figure 6:
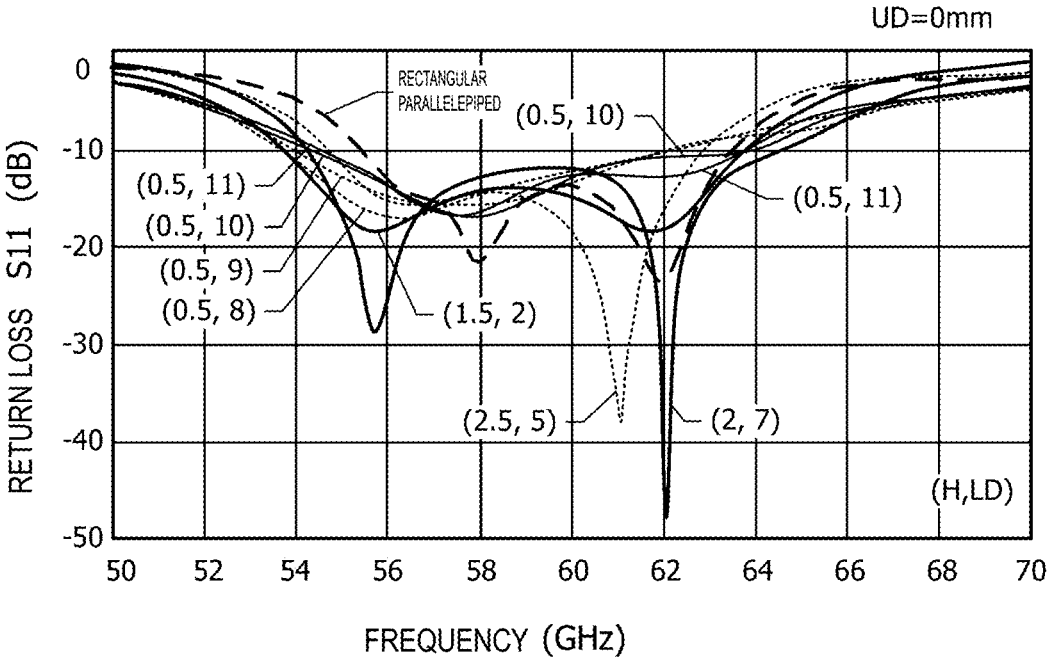
FIG. 6 is a graph illustrating the simulation results regarding the relationship between the frequency and the return loss S11 of the antenna device of the second embodiment.

FIG. 6 is a graph illustrating the simulation results regarding the relationship between the frequency and the return loss S11 of the antenna device according to the second embodiment. The horizontal axis indicates the frequency by the unit "GHz", while the vertical axis indicates the return loss S11 by the unit "dB". The two numeric values in parentheses appended to the solid lines and the broken lines in the graph in FIG. 6 refer to the height H and the diameter LD of the bottom surface sequentially from the left. For the sake of reference, the return loss S11 of an antenna device including a dielectric member formed in a rectangular parallelepiped is indicated by the long dashed line.

The graph shows that, when the height H of the dielectric member 20 in a conical shape is in a range of 0.5 to 2.5 mm and the diameter LD of the bottom surface is 2 to 11 mm, it is possible to implement a band as wide as or even wider than the configuration in which the dielectric member 20 is formed in a rectangular parallelepiped. In this manner, even when the dielectric member 20 is formed in a conical shape, advantages similar to those of the first embodiment can also be obtained.

Third Embodiment

An antenna device according to a third embodiment will be described below with reference to FIGS. 7, 8A, and 8B. An explanation of the elements configured in the same manner as the antenna device of the first embodiment (FIGS. 1 and 2) will be omitted.

Figure 7:
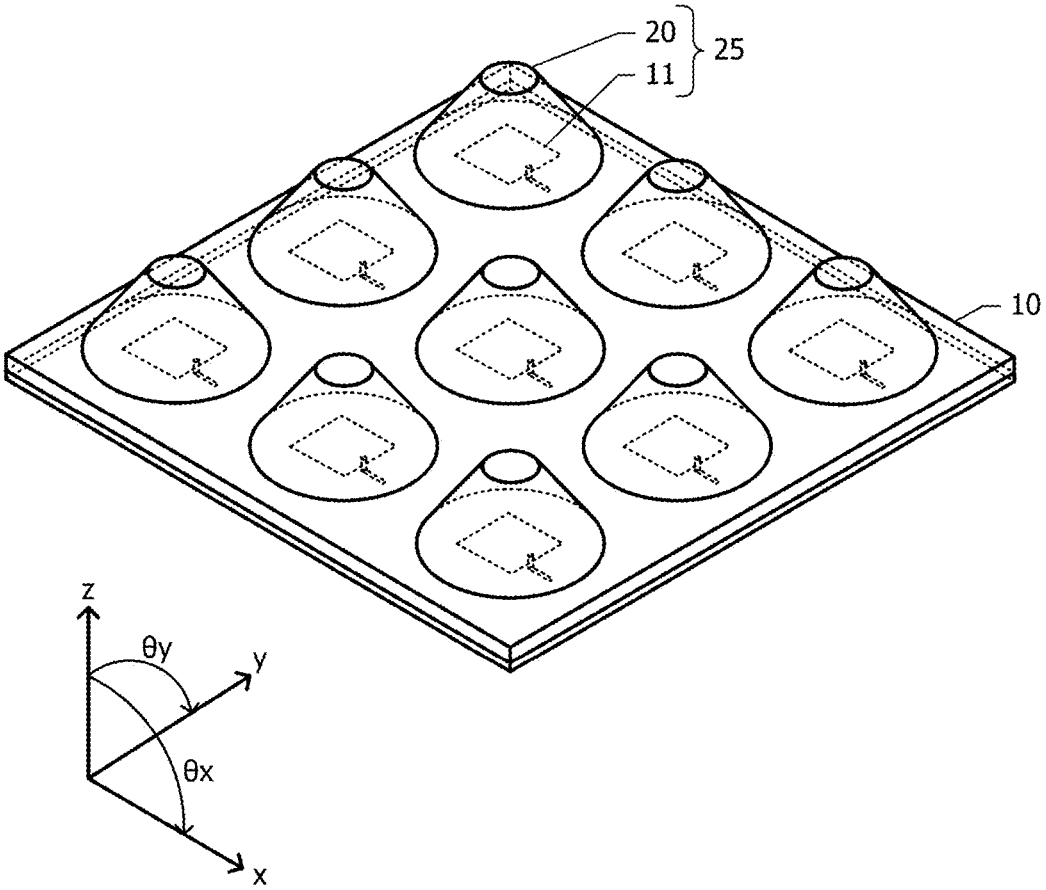
FIG. 7 is a perspective view of an antenna device according to a third embodiment.

FIG. 7 is a perspective view of the antenna device according to the third embodiment. In the first embodiment, one radiation element 11 and one dielectric member 20 are disposed on the substrate 10. In the third embodiment, one radiation element 11 and one dielectric member 20 form one element unit 25, and plural element units 25 are disposed on the single substrate 10. For example, nine element units 25 are disposed in a matrix of three rows and three columns so as to form an array antenna.

A Cartesian coordinate system having xyz axes is defined as follows. The direction in which the feed line 12 extends from the radiation element 11 as viewed from above is the positive direction of the x axis. The direction perpendicular to the positive direction of the x axis is the y-axis direction. The direction of a normal line to the top surface of the substrate 10 is the positive direction of the z axis. The relationship between the antenna gain of the antenna device of the third embodiment and the tilt angle with respect to the direction of the normal line (positive direction of the z axis) was determined by a simulation.

Figure 8A:
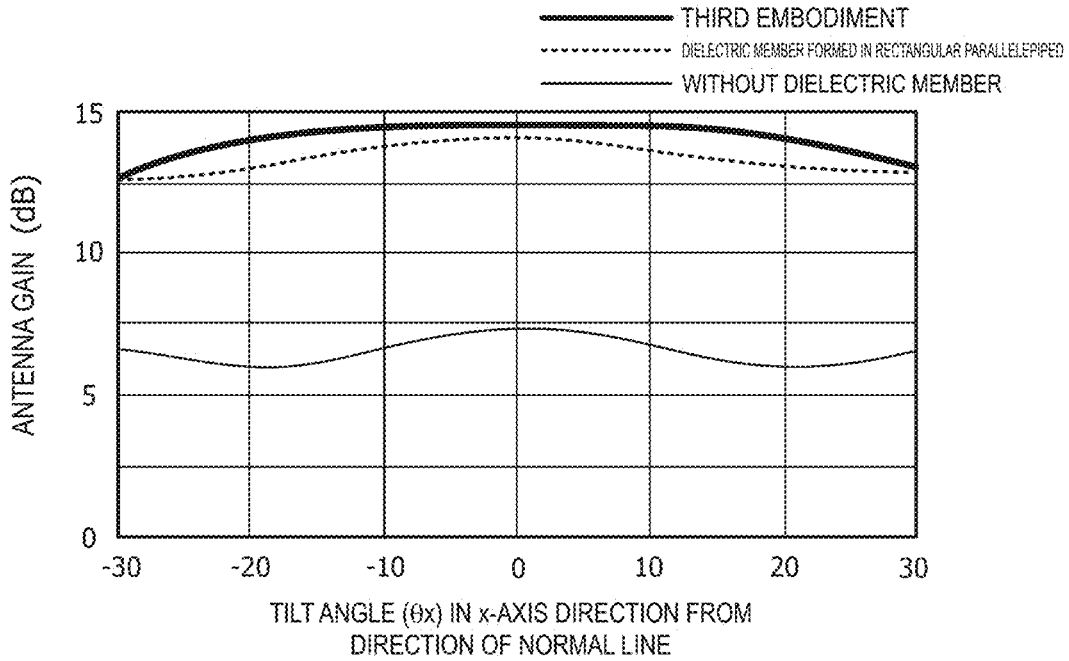
FIG. 8A is a graph illustrating the relationship between the antenna gain of the antenna device according to the third embodiment and the tilt angle θx in the x-axis direction from the direction of a normal line.
Figure 8B:
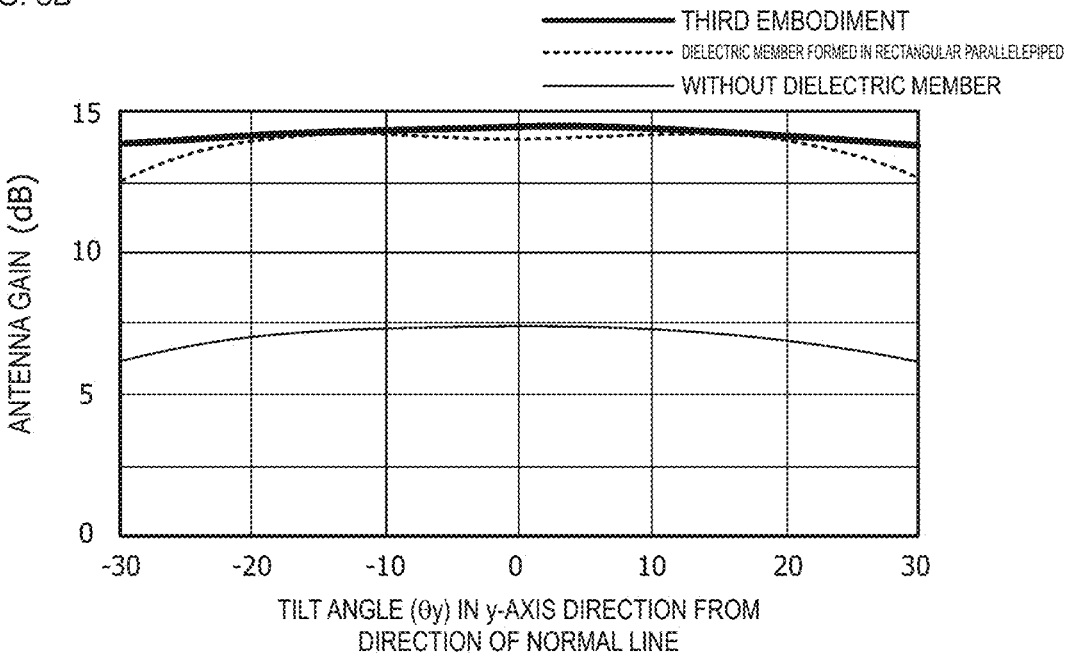
FIG. 8B is a graph illustrating the relationship between the antenna gain of the antenna device according to the third embodiment and the tilt angle θy in the y-axis direction from the direction of the normal line.

FIG. 8A is a graph illustrating the relationship between the antenna gain and the tilt angle θx in the x-axis direction from the direction of the normal line. FIG. 8B is a graph illustrating the relationship between the antenna gain and the tilt angle θy in the y-axis direction from the direction of the normal line. In FIGS. 8A and 8B, the horizontal axes respectively represent the tilt angles θx and θy by the unit "degree", while the vertical axes represent the antenna gain by the unit "dB". The thick solid lines in the graphs of FIGS. 8A and 8B indicate the antenna gain of the antenna device of the third embodiment. The broken lines indicate the antenna gain of an antenna device including a dielectric member formed in a rectangular parallelepiped instead of the dielectric member 20 (FIG. 7). The thin solid lines indicate the antenna gain of an antenna device without any dielectric member. Regarding the dielectric member 20 in a truncated conical shape, the height was 1 mm, the diameter of the bottom surface was 2 mm, and the diameter of the top surface was 0.6 mm. Regarding the dielectric member 20 in a rectangular parallelepiped, the bottom surface was a square shape, each side of which was 2.5 mm, and the height was 0.5 mm. The shapes and the values of the dimensions were optimized to achieve desirable antenna characteristics. The center-to-center distance between the radiation elements 11 both in the x-axis direction and in the y-axis direction was 2.5 mm. The operating frequency was 60 GHz.

The simulation results show that, as a result of mounting the truncated conical dielectric member 20 on each of the radiation element 11, a high antenna gain is obtained in a tilt angle of −30° to 30°, compared with when no dielectric member 20 is provided, and a high antenna gain is also obtained in a tilt angle of −30° to 30°, compared with when the dielectric member 20 in rectangular parallelepiped is used. As a result of applying the truncated conical dielectric members 20 to an array antenna, a high antenna gain can be obtained. A wider band is also achieved as in the first embodiment.

Fourth Embodiment

An antenna device according to a fourth embodiment will be described below with reference to FIG. 9A. An explanation of the elements configured in the same manner as the antenna device of the first embodiment (FIGS. 1 and 2) will be omitted.

Figure 9A:
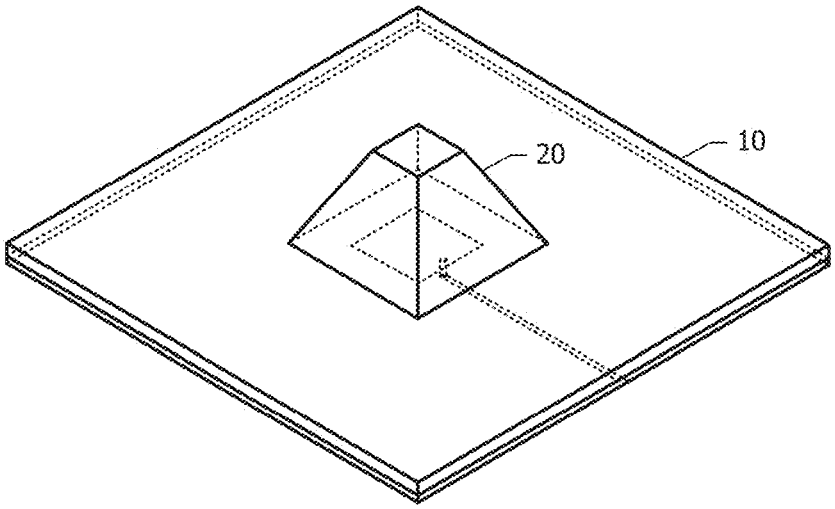
FIGS. 9A and 9B are respectively a sectional view of an antenna device according to a fourth embodiment and that according to a modified example of the fourth embodiment.

FIG. 9A is a perspective view of the antenna device according to the fourth embodiment. The dielectric member 20 in the first embodiment (FIG. 1) is formed in a truncated cone. The dielectric member 20 in the fourth embodiment is formed in the shape of a truncated square pyramid. The individual sides of the top surface and the bottom surface of the dielectric member 20 are parallel with the sides of the radiation element 11. As in the first embodiment, the centers of the top and bottom surfaces of the dielectric member 20 and the center of the radiation element 11 coincide with each other, as viewed from above.

The preferable dimensions of the dielectric member 20 in the fourth embodiment will be discussed below. The preferable range of the height of the dielectric member 20 in the fourth embodiment is the same as the first embodiment. The dimensions of the top surface and those of the bottom surface of the dielectric member 20 are defined by the area of the top surface and that of the bottom surface, respectively. The preferable range of the area of the top surface and that of the bottom surface of the dielectric member 20 are respectively the same as that of the circular top surface and that of the bottom surface of the dielectric member 20 in the first embodiment.

Advantages of the fourth embodiment will be discussed below. In the dielectric member 20 formed in a truncated square pyramid, too, radio waves are reflected in the dielectric member 20 to generate multi-resonance. Hence, as in the first embodiment, a wider band of the antenna device is achieved.

Figure 9B:
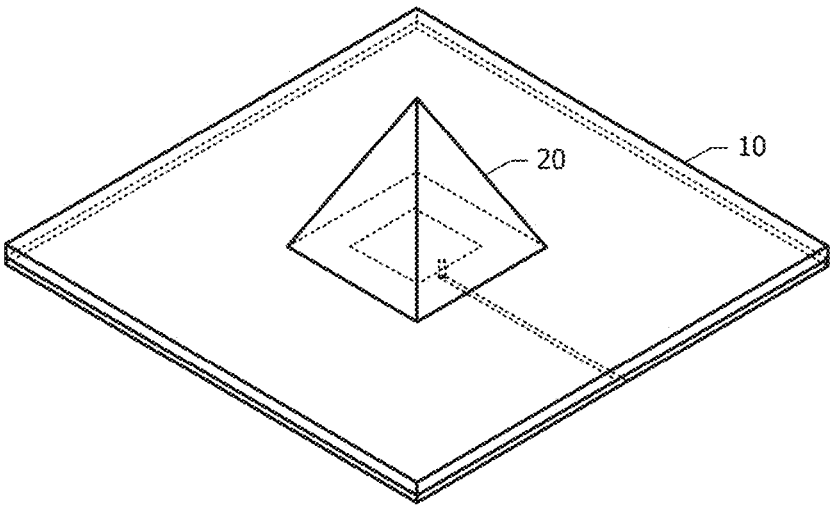

A modified example of the fourth embodiment will be discussed below. The dielectric member 20 may be formed in the shape of a square pyramid, as shown in FIG. 9B. Alternatively, the dielectric member 20 may be formed in a truncated pyramid having top and bottom surfaces formed in a polygon other than a square or a pyramid having a bottom surface formed in a polygon other than a square.

To reduce the orientation dependence of the antenna characteristics, the dielectric member 20 is preferably formed to have a rotationally symmetrical configuration about the axis parallel with the height direction as the rotation center. When the top and bottom surfaces of the dielectric member 20 are rectangles, the dielectric member 20 has two-order symmetry characteristics. When the top and bottom surfaces of the dielectric member 20 are squares, the dielectric member 20 has four-order symmetry characteristics. When the top and bottom surfaces of the dielectric member 20 are circles, the dielectric member 20 has a circularly symmetrical configuration.

Fifth Embodiment

A communication apparatus according to a fifth embodiment will be described below with reference to FIG. 10.

Figure 10:
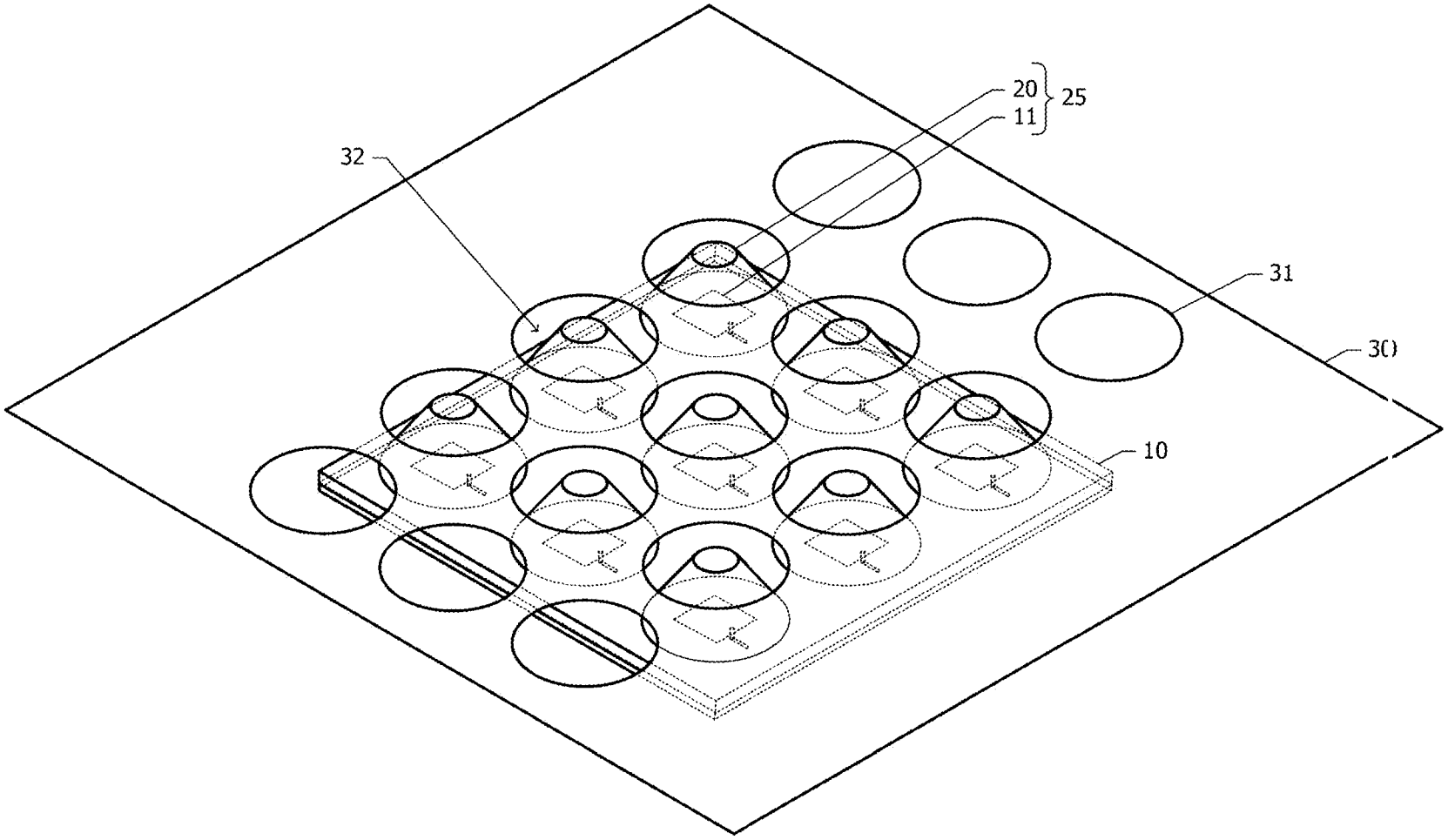
FIG. 10 is a partial perspective view of a communication apparatus according to a fifth embodiment.

FIG. 10 is a partial perspective view of the communication apparatus of the fifth embodiment. The communication apparatus of the fifth embodiment includes a housing 30 and an antenna device 32 stored in the housing 30. In FIG. 10, only part of the housing 30 is shown. As the antenna device 32, the antenna device of the third embodiment (FIG. 7) is used.

Part of the housing 30 opposes the top surface of the substrate 10 of the antenna device 32 with a spacing therebetween. The portion of the housing 30 opposing the top surface of the substrate 10 (hereinafter such a portion will be called an antenna opposing portion) is formed of a conductive material, such as a metal. Multiple circular apertures 31 are formed at the antenna opposing portions of the housing 30. The multiple apertures 31 are located in association with the respective radiation elements 11 and each include the associated radiation elements 11 therein as viewed from above.

Advantages of the fifth embodiment will be described below.

In the fifth embodiment, radio waves emitted from the radiation elements 11 are not blocked by the housing 30 made of a metal, for example, and are instead radiated to a space outside the housing 30 via the associated apertures 31. To efficiently radiate radio waves to the outside of the housing 30, it is preferable that the apertures 31 be each formed in a size which covers a 3-dB beamwidth of the associated radiation element 11. In addition to the apertures 31 provided in association with the radiation elements 11, apertures 31 may be provided for portions other than the radiation elements 11. This makes it less likely to reduce the antenna gain in a direction leaning from the direction of a normal line.

Modified examples of the fifth embodiment will be discussed below.

Although the apertures 31 are circular in the fifth embodiment, they may be formed in another shape. If beamforming is performed in a specific plane, the apertures 31 may be formed in a shape elongated in a direction parallel with the plane to be subjected to beamforming, such as an ellipse or a racetrack. In this case, one aperture 31 may be provided for plural radiation elements 11 arranged in a direction parallel with the plane to be subjected to beamforming.

In the fifth embodiment, the apertures 31 are open, but they may be closed with the dielectric member.

The above-described embodiments are only examples. The configurations described in different embodiments may partially be replaced by or combined with each other. Similar advantages obtained by similar configurations in plural embodiments are not repeated in the individual embodiments. The present disclosure is not restricted to the above-described embodiments. It is to be understood that variations, improvements, and combinations, for example, will be apparent to those skilled in the art.

REFERENCE SIGNS LIST

10 substrate
11 radiation element
12 feed line
13 via-conductor
15 ground conductor
17 adhesive layer
20 dielectric member
25 element unit
30 housing
31 aperture
32 antenna device

The invention claimed is:

1. An antenna device comprising:

a patch antenna including a radiation element and a ground conductor, the radiation element being disposed in or on a substrate, the ground conductor being disposed in or on the substrate; and a dielectric member that is homogeneous and disposed to at least partially cover, in a plan view, the radiation element and is disposed on a side opposite another side on which the ground conductor is disposed as viewed from the radiation element, wherein under a condition a direction of a normal line to the radiation element is assumed as a height direction and an imaginary plane perpendicular to the height direction is assumed as a reference plane, the dielectric member has a side surface which tilts with respect to the reference plane, and under another condition in which a value that is obtained by dividing a dimension of the radiation element in an excitation direction by a square root of a relative permittivity of the dielectric member is set to be a reference value, a diameter that defines a circular shaped area of a top surface of the dielectric member is in an inclusive range of 1.8 through 3.8 times as large as the reference value.

2. The antenna device according to claim 1, wherein the dielectric member has no focal point for a radio wave entering the dielectric member in parallel with the height direction.

3. The antenna device according to claim 1, wherein:

the dielectric member has a bottom surface and the top surface, the bottom surface facing the radiation element, the top surface opposing the bottom surface, a height of the dielectric member is in an inclusive range of 1.5 through 3.2 times the reference value, and the bottom surface of the dielectric member has a circular area defined by a diameter which is in an inclusive range of 6.3 through 35 times the reference value.

4. The antenna device according to claim 2, wherein:

the dielectric member has a bottom surface and the top surface, the bottom surface facing the radiation element, the top surface opposing the bottom surface, a height of the dielectric member is in an inclusive range of 1.5 through 3.2 times the reference value, and the bottom surface of the dielectric member has a circular area defined by a diameter which is in an inclusive range of 6.3 through 35 times the reference value.

5. The antenna device according to one of claim 1, wherein the dielectric member has a shape of a cone, a truncated cone, a polygonal pyramid, or a truncated polygonal pyramid.

6. The antenna device according to one of claim 2, wherein the dielectric member has a shape of a cone, a truncated cone, a polygonal pyramid, or a truncated polygonal pyramid.

7. The antenna device according to one of claim 3, wherein the dielectric member has a shape of a cone, a truncated cone, a polygonal pyramid, or a truncated polygonal pyramid.

8. The antenna device according to one of claim 4, wherein the dielectric member has a shape of a cone, a truncated cone, a polygonal pyramid, or a truncated polygonal pyramid.

9. The antenna device according to claim 1, wherein the dielectric member has a rotationally symmetrical configuration about an axis parallel with the height direction as a rotation center.

10. The antenna device according to claim 2, wherein the dielectric member has a rotationally symmetrical configuration about an axis parallel with the height direction as a rotation center.

11. The antenna device according to claim 3, wherein the dielectric member has a rotationally symmetrical configuration about an axis parallel with the height direction as a rotation center.

12. The antenna device according to claim 4, wherein the dielectric member has a rotationally symmetrical configuration about an axis parallel with the height direction as a rotation center.

13. The antenna device according to claim 5, wherein the dielectric member has a rotationally symmetrical configuration about an axis parallel with the height direction as a rotation center.

14. The antenna device according to claim 6, wherein the dielectric member has a rotationally symmetrical configuration about an axis parallel with the height direction as a rotation center.

15. The antenna device according to claim 7, wherein the dielectric member has a rotationally symmetrical configuration about an axis parallel with the height direction as a rotation center.

16. The antenna device according to claim 8, wherein the dielectric member has a rotationally symmetrical configuration about an axis parallel with the height direction as a rotation center.

17. The antenna device according to claim 1, wherein the radiation element and the dielectric member collectively form an element, and a plurality of the elements are disposed on the substrate so as to form an array antenna.

18. The antenna device according to claim 2, wherein the radiation element and the dielectric member collectively form an element, and a plurality of the elements are disposed on the substrate so as to form an array antenna.

19. The antenna device according to claim 5, wherein the radiation element and the dielectric member collectively form an element, and a plurality of the elements are disposed on the substrate so as to form an array antenna.

20. An antenna device comprising:

a patch antenna including a radiation element and a ground conductor, the radiation element being disposed in or on a substrate, the ground conductor being disposed in or on the substrate; and a dielectric member that is disposed to at least partially cover, in a plan view, the radiation element and is disposed on a side opposite another side on which the ground conductor is disposed as viewed from the radiation element, wherein under a condition a direction of a normal line to the radiation element is assumed as a height direction and an imaginary plane perpendicular to the height direction is assumed as a reference plane, the dielectric member has a side surface which tilts with respect to the reference plane, the dielectric member has no focal point for a radio wave entering the dielectric member in parallel with the height direction, and under another condition in which a value that is obtained by dividing a dimension of the radiation element in an excitation direction by a square root of a relative permittivity of the dielectric member is set to be a reference value, a diameter that defines a circular shaped area of a top surface of the dielectric member is in an inclusive range of 1.8 through 3.8 times as large as the reference value.

* * * * *